United States Patent [19]

Heft

[11] 3,986,462

[45] Oct. 19, 1976

[54] DECK STRUCTURE FOR RACKS

[76] Inventor: Kenneth W. Heft, 7150 N. Terra Vista Drive, Apt. 411, Peoria, Ill. 61614

[22] Filed: May 14, 1975

[21] Appl. No.: 577,298

[52] U.S. Cl. ..... 108/111; 211/188; 211/153

[51] Int. Cl.[2] ..... A47B 3/00

[58] Field of Search ..... 108/111, 157, 159; 211/135, 148, 153

[56] References Cited

UNITED STATES PATENTS

| | | | |
|---|---|---|---|
| 3,042,221 | 7/1962 | Rasmussen | 211/148 |
| 3,268,089 | 8/1966 | Hall | 211/153 |
| 3,322,077 | 5/1967 | Kovacik | 108/111 |

*Primary Examiner*—James C. Mitchell

*Attorney, Agent, or Firm*—Henderson, Strom & Sturm

[57] ABSTRACT

Front to back members having elongated main members with flanged end pieces being affixed thereto at each end. The front to back members are placed upon the shelf beam members of a rack. The shelf beam members are cradled between the flanged end pieces and the main members of the front to back member. Shelving members are placed upon the shelf beams between the front to back members. Support members span the shelf beams beneath the front to back and shelving members. The main members may be fixed together in a side by side relationship and attached between lengthened flanged end pieces to form an enlarged front to back member.

6 Claims, 7 Drawing Figures

DECK STRUCTURE FOR RACKS

BACKGROUND OF THE INVENTION

This invention relates to decking or shelving used on industrial racks used for storage of goods.

Shelving used today consists mainly of plywood or other wooden panels which either fit in the beam steps of the shelf beams of the rack or are supported in channels affixed to the shelf beams of the racks. Some shelving consists of continuous metal sheets which fit over the shelf beams of the rack and which rest upon channels of continuous sheet metal fitted within the beam steps of the shelf beams. These shelving structures are unsatisfactory because the wooden panels may burn, and the solid continuous nature of both the wooden and sheet metal shelving types hinders the free flow of water through the rack structure in the event of a fire. A sprinkling system is therefore required at each level of the rack structure to provide adequate fire protection.

Some shelving consists of wire mesh fitted over the shelf beams of the rack. Narrow metal channels are welded to the underside of the mesh to provide support. While water may flow freely through this type of shelving, the structure is weak and is prone to twisting when a heavy load is placed upon the mesh intermediate to where channels have been welded thereon. Additionally, the weldments tend to break easily thereby rendering the structure weaker.

SUMMARY OF THE INVENTION

According to this invention, a deck structure for racks is provided having a plurality of detachable front to back members, shelving members and support members.

The front to back members each have a main member with depending sides and flanged members affixed to each end of the main member. The main member fits upon the beam steps formed on the inner sides of the beam members of the rack. The flanged members rest upon the top parts of the beam members and press inwardly against the outside surfaces of the beam members. Several main members may be joined in a side by side relationship, and a lengthened flanged member may then by attached to each end of the joined main members.

The shelving members are elongated and have depending sides. The shelving members fit upon the beam steps of the shelf beams and are placed between the front to back members. The depending sides of the front to back members and the shelving members are pressed together to form strong supports.

Shelving support members may be used and are of the same structure as the shelving members but with smaller dimensions. The shelving supports fit into the beam steps of the beam members and fit snugly within and against the shelving members and the main members of the front to back members placed over the shelving supports.

It is an object of this invention to provide a novel and improved decking structure for racks.

It is another object of this invention to provide a deck structure which will significantly reduce fire hazards of racks by allowing water to flow freely therethrough and by being constructed of a fire resistant material.

Still another object is to provide a deck structure which is strong and may readily support heavy loads without twisting or buckling.

A further object is to provide a deck structure which is rugged in construction yet simple and economical to manufacture.

These objects and other features and advantages of this invention will become readily apparent by reference to the following description when taken in conjunction with the accompanying drawings.

BRIEF DESCRIPTION OF THE DRAWINGS

The appended drawings illustrate the invention wherein.

DESCRIPTION OF THE PREFERRED EMBODIMENT

Figure 2:
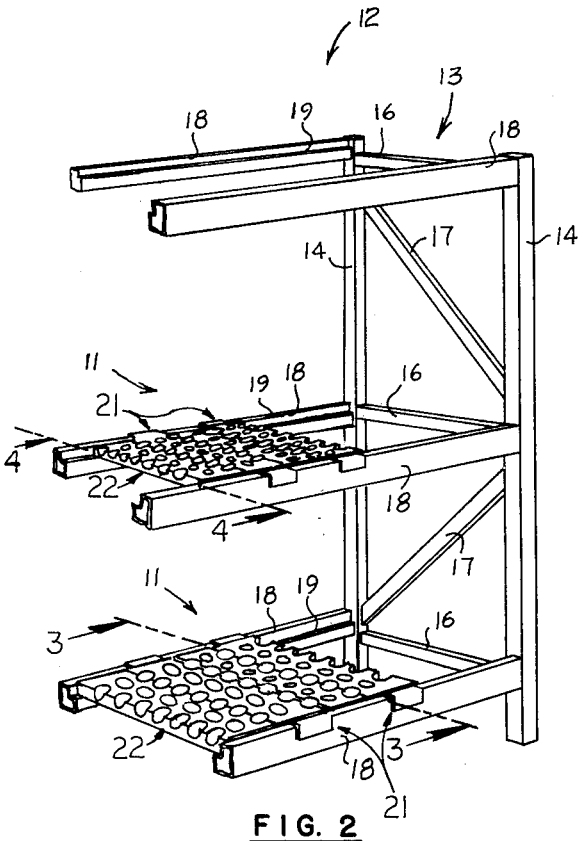
FIG. 2 is an enlarged perspective view of the deck structure of this invention mounted upon a rack of conventional construction.

Referring now to the drawings, the deck structure of this invention is generally indicated at 11 in FIG. 2 in attachment with a rack 12 of conventional construction. Such racks 12 normally include several uniformly spaced upright frame members 13. The upright frame members 13 ordinarily include a pair of upright columns 14 which are connected by uniformly vertically spaced horizontal braces 16. Diagonal bracing members 17 connect the upright columns 14 at points between consecutive spaced horizontal braces 16. The racks 12 normally include uniformly vertically spaced pairs of transversely spaced shelf beam members 18 extending between consecutive upright frame members 13. Beam steps 19 are formed in the inside sides of the shelf beams 18, and therefore the beam step 19 of one of a pair of transversely spaced shelf beams 18 faces toward the beam step 19 of the other shelf beam 18.

Referring still to FIG. 2, the deck structure 11 of this invention generally includes several front to back members 21, several shelving members 22, and several shelving support members 23.

Figure 1:
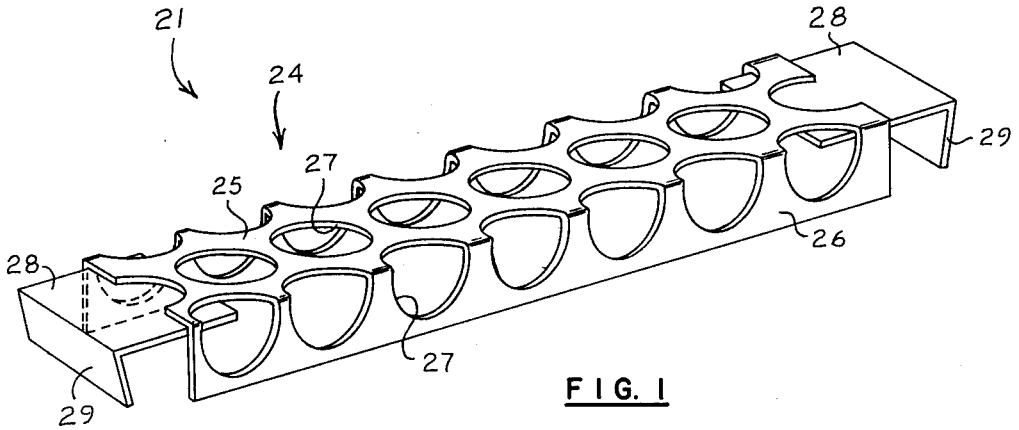
FIG. 1 is a perspective view of the front to back member of this deck structure.
Figure 3:
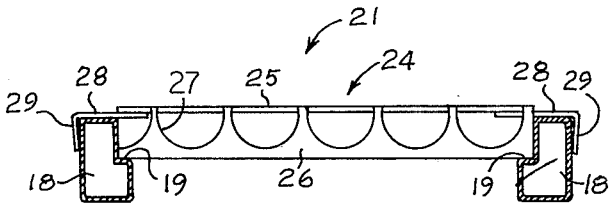
FIG. 3 is an enlarged, fragmentary side elevational view taken along line 3—3 of FIG. 2 showing the mounting of a front to back member of this deck structure.

More particularly referring to FIG. 1, the front to back members 21 each include an elongated main member 24 having a top portion 25 and side members 26. The side members 26 depend from the longitudinal edges of the top portion 25 and are in perpendicular relationship to the top portion 25. Circular holes 27 are formed in the top portion 25 and depending sides 26.

The front to back members 21 have end pieces 28 affixed to each end of the top portions 25 of the elongated main members 24. At the end opposite its end of attachment to the top portion 25, each end piece 28 has a flange member 29 which is turned downwardly and inwardly toward the main member 24.

Figure 6:
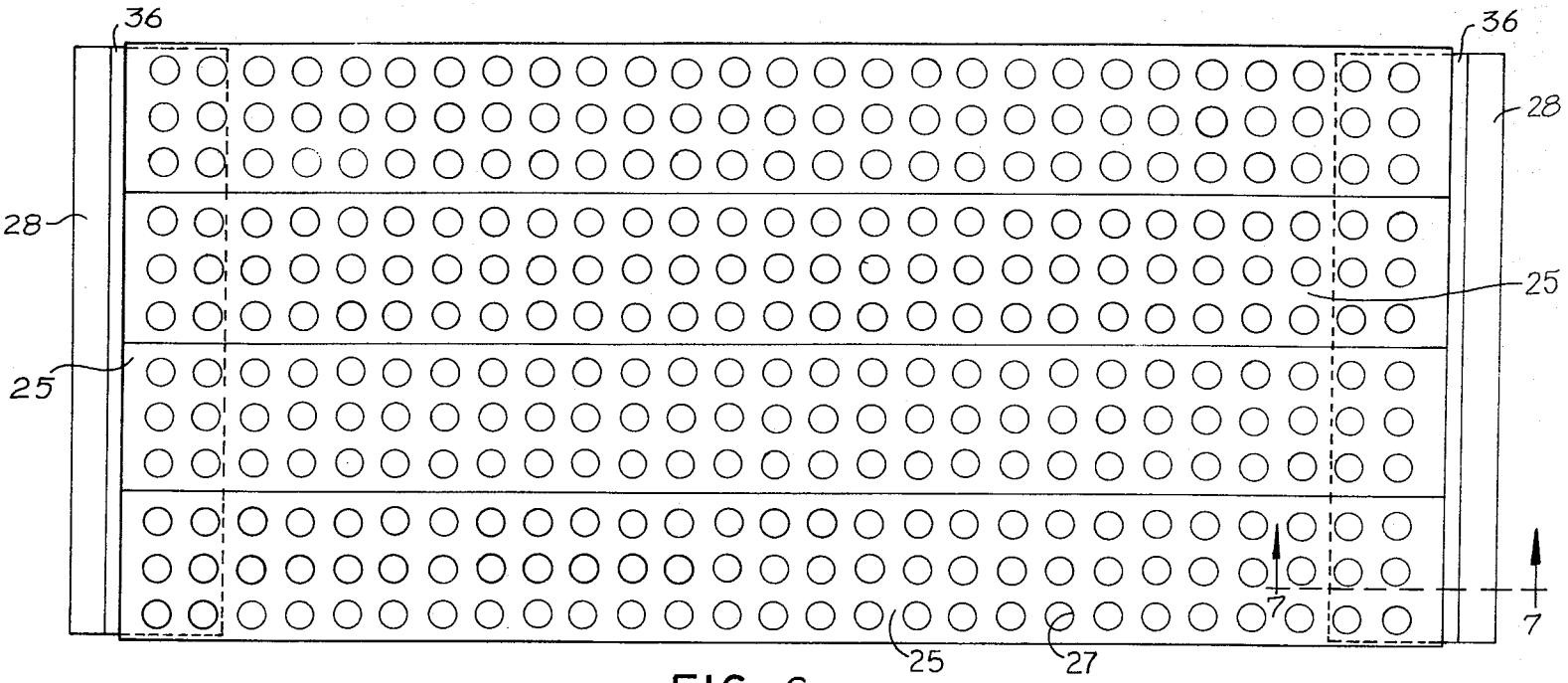
FIG. 6 is a top plan view of a modified form of a front to back member of this deck structure.
Figure 7:
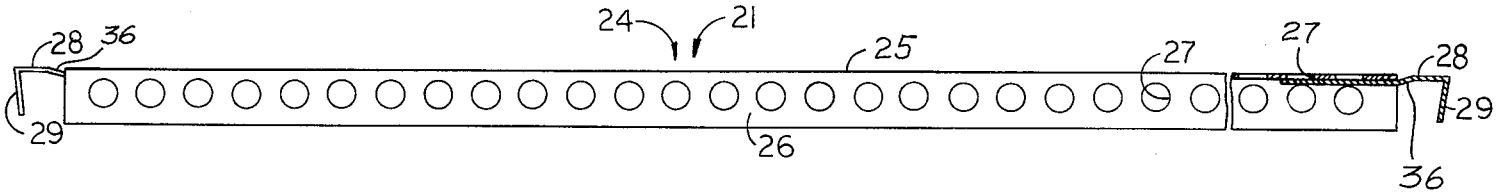
FIG. 7 depicts the modified front to back member partly in a side elevational view and partly in a sectional view taken along line 7—7 of FIG. 6.

Referring to FIGS. 6 and 7, a modified front to back member 21 is depicted. The modified member 21 includes a plurality (four are shown in FIG. 6) of elongated main members 24, each having a top portion 25, side members 26 perpendicular to and depending from the portion 25 and holes 27 formed in the top 25 and sides 26. The main members 24 are affixed together in a side by side manner, the depending sides 26 being juxtapositioned in pairs except for the outwardly facing sides 26 of the outside members 24.

The joined main members 24 at each end have a lengthened end piece 28 attached thereto. Each end piece 28 has a lower flat portion, attached to the joined main members 24, and a raised flat portion, the lower and raised flat portions being joined by an upwardly curved portion 36. The curved portion 36, together with a lengthened flange portion 29, enables the end piece 28 to securely cradle a shelf beam 18, the flange member 29 being turned downwardly and inwardly toward the joined main members 24.

Figure 4:
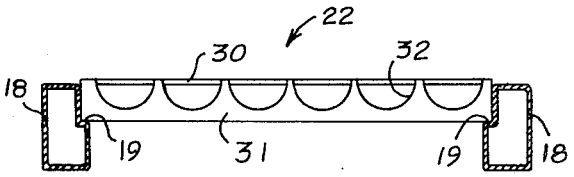
FIG. 4 is an enlarged, fragmentary side elevational view taken along line 4—4 of FIG. 2 showing the mounting of a shelving member of this deck structure.

The shelving members 22 (FIG. 4) each have an elongated top portion 30 and side members 31 depending perpendicularly from the longitudinal edges of the top portion 30. Circular holes 32 are formed in the top portion 30 and side members 31.

Figure 5:
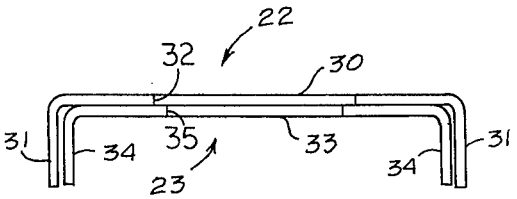
FIG. 5 is an end elevational view showing a shelving support member of this deck structure fitted within a shelving member.

Smaller shelving support members 23 (FIG. 5) also have elongated top portions 33 with perpendicularly depending sides 34. Top portions 33 and side members 34 have circular holes 35 formed therein.

When in use, the front to back members 21 are placed upon the rack 12 by placing the outer ends of the depending sides 26 of the main members 24 upon the beam steps 19 of the shelf beam members 18. The end pieces 28 rest upon the tops of the shelf beams 18, and the flanges 29 turn toward and fit against the outwardly directed sides of the shelf beams 18. The front to back members 21 thereby extend between and securely cradle the transversely spaced shelf beams 18.

The shelving members 22 are placed between consecutive front to back members 21. Each of the shelving members 22 are placed upon the rack 12 by fitting the outer ends of the depending sides 31 into the beam steps 19 of the shelf beam members 18. The shelving members 22 and the front to back members 21 are fitted against each other so that the depending sides 26, 31 are firmly juxtapositioned in pairs.

The shelving support members 23, if used, are placed upon the rack 12 before either the front to back members 21 or the shelving members 22. The outer ends of the depending sides 34 are inserted into the beam steps 19 of the shelf beams 18. The dimensions of the shelving support members 23 are slightly smaller than those of the shelving members 22 or the main members 24. The shelving supports 23 thereby fit snugly within and against the front to back members 21 and shelving members 22 to provide firm support when heavier loads are being supported.

The front to back members 21, shelving members 22 and support members 23 are all easily detachable from the rack 12.

The front to back members 21, shelving members 22 and shelving supports 23 are preferably made of metal. The holes 27,32,35 formed in the respective structures readily admit the flow of water. The deck structure 11 of this invention greatly minimizes risk of serious fire.

The maximum preferable width of the top portions 25,30 is six inches. The pairs of juxtaposed sides 26,31 are thereby closely spaced resulting in a deck structure 11 of great strength. Additionally, the flange members 29 by pressing inwardly against the shelf beams 18 aid in preventing the front to back members 21 and the shelving members 22 from twisting under a heavy load.

The deck structure 11 can be extended between the shelf beams 18 from one upright frame members 13 completely over to the next upright frame member 13. Spaces between shelf beams 18 through which heavy objects might fall to cause injury are thereby eliminated.

Thus it can be seen that the deck structure 11 set forth herein fulfills the objects of this invention.

Although a preferred embodiment has been disclosed herein, it is to be remembered that various modifications and alternate constructions can be made thereto without departing from the full scope of the invention, as defined in the appended claims.

I claim:

1. For use with racks having a plurality of spaced upstanding members with shelf beam members affixed therebetween, the shelf beam members having beam steps formed in the inside sides thereof, a deck structure comprising:

a plurality of front to back means each extending between the shelf beam members and having an elongated main member and a pair of end pieces, said elongated main member resting upon the beam steps of the shelf beam members, each of said end pieces being affixed to one end of said elongated member and hooked over one of said shelf beam members, each of said end pieces including a flange member, said flange member being turned downwardly and inwardly toward said elongated main member and the shelf beam member and against the side of the shelf beam member opposite the side having the beam step formed therein;

a plurality of shelf means extending between the shelf beam members, each of said shelf means resting upon the beam steps of the shelf beam members, said shelf means being interposed between and adjacent to said front to back means; and each elongated main member and each shelf means including a top portion and a pair of elongated rectangular sides, both of said sides depending from the longitudinal edges of said top portion, each of said sides being flush against another of said sides to form a double thickness support when said front to back means and said shelf means are placed upon the shelf beam members.

2. A deck structure as defined in claim 1 and wherein the maximum width of said top portions between said longitudinal edges is six inches.

3. A deck structure as defined in claim 1 and wherein a plurality of support means rest upon the beam steps of the shelf beam members and directly underneath and against said elongated main members and said shelf means, each support means including an elongated horizontal upper portion and a pair of vertical depending portions, said vertical depending portions being attached to the longitudinal edges of said horizontal upper portion, said vertical depending portions being somewhat shorter in vertical dimension than said sides, said horizontal upper portions being directly underneath and against said top portions, said vertical depending portions being adjacent said sides, whereby quadruple thickness supports are formed.

4. A deck structure as defined in claim 3 and wherein each of said front to back means, shelving means and support means have holes formed therein whereby water may pass freely therethrough.

5. A deck structure as defined in claim 1 and further wherein each of said front to back means includes a plurality of said elongated main members joined together in a side by side manner, each of said sides of each of said main members being flush against one of said sides of another of said main members to form a double thickness support, said end pieces being affixed to each end of said joined elongated main members, whereby each front to back means has a plurality of formed double thickness supports.

6. A deck structure as defined in claim 1 and further wherein each of said end pieces has a lower flat portion affixed to said elongated main member, a raised flat portion, and an upwardly curved portion interconnecting said lower and said raised flat portions, said flange member being turned downwardly from said raised flat portion and inwardly toward said curved portion, whereby said end piece cradles a shelf beam member.

* * * * *

UNITED STATES PATENT AND TRADEMARK OFFICE

CERTIFICATE OF CORRECTION

PATENT NO. : 3,986,462

DATED : October 19, 1976

INVENTOR(S) : Kenneth W. Heft

It is certified that error appears in the above-identified patent and that said Letters Patent are hereby corrected as shown below:

In column 2, lines 57-58, --small-- should be inserted between "several" and "shelving".

In column 4, line 33, in claim 1 --main-- should be inserted between "elongated" and "member".

Signed and Sealed this

Twenty-first Day of December 1976

[SEAL]

*Attest:*

RUTH C. MASON
*Attesting Officer*

C. MARSHALL DANN
*Commissioner of Patents and Trademarks*